US007758215B2

(12) United States Patent
Secen et al.

(10) Patent No.: US 7,758,215 B2
(45) Date of Patent: Jul. 20, 2010

(54) PAR LAMP WITH SHORT ARC HID BULB AND CUT-OUT IN ALUMINUM TO PREVENT ARCING

(75) Inventors: Michael Matthew Secen, Lawrenceburg, KY (US); David A. Gwinn, Lexington, KY (US)

(73) Assignee: General Electric Company

( * ) Notice: Subject to any disclaimer, the term of this patent is extended or adjusted under 35 U.S.C. 154(b) by 169 days.

(21) Appl. No.: 12/112,465

(22) Filed: Apr. 30, 2008

(65) Prior Publication Data

US 2009/0273934 A1 Nov. 5, 2009

(51) Int. Cl.
*F21V 7/00* (2006.01)

(52) U.S. Cl. ..... 362/297; 362/296.01; 362/263; 362/262; 362/267

(58) Field of Classification Search ..... 362/263, 362/262, 267, 341, 347, 296.01, 297
See application file for complete search history.

(56) References Cited

U.S. PATENT DOCUMENTS 5,387,800 A * 2/1995 Kurtich et al. ..... 250/504 R
5,585,697 A 12/1996 Cote et al.
6,000,815 A * 12/1999 Jennings ..... 362/285
6,439,752 B1 * 8/2002 Petrick ..... 362/470
2007/0285916 A1 * 12/2007 Strobl et al. ..... 362/220
2009/0273934 A1 * 11/2009 Secen et al. ..... 362/310

* cited by examiner

*Primary Examiner*—Jacob Y Choi
(74) *Attorney, Agent, or Firm*—Fay Sharpe LLP

(57) ABSTRACT

A lamp is disclosed that includes a light source that requires high voltage for starting. A reflector body includes an electrically conductive reflective surface that is oriented to receive light from the light source and direct the light in the desired direction. A preselected surface portion of the reflector body is devoid of the electrically conductive reflective surface. First and second lead assemblies associated with the light source, and that supply power thereto, pass through openings in the reflector body. The lead assemblies are spaced from the electrically conductive reflective surface portion by the preselected surface portion that is devoid of the reflective material to preclude arcing. Asymmetrical lead wire assemblies may also be advantageously used to increase the electrical standoff.

17 Claims, 4 Drawing Sheets

PAR LAMP WITH SHORT ARC HID BULB AND CUT-OUT IN ALUMINUM TO PREVENT ARCING

BACKGROUND

This application is directed to a lamp assembly, and more particularly a high brightness lamp assembly such as a high intensity discharge (HID) light source incorporated into a parabolic reflector (PAR) housing and enclosure. The enclosure includes the housing or body, an internal surface of which is coated with a conductive reflective layer and an enlarged end of the parabolic body is closed by a lens.

Typically, the light source or bulb is inserted or mounted in the housing where an axis of the light source is substantially perpendicular to an axis of revolution of the parabolic surface. In known designs, arcing is a potential issue between the mount leads and the conductive reflective coating, particularly during hot restart applications. That is, if arcing occurs, the lamp assembly will not restart.

In the past, PAR lamps, and specifically those that incorporate high intensity discharge mount leads, have used insulators on the leads as one manner of addressing the potential arcing issue. Another possible solution is to provide a coating, such as a dichroic coating, on the reflective surface to prevent the arcing. Unfortunately, the dichroic coating requires an additional manufacturing operation and, particularly, the additional manufacturing steps are labor intensive. Consequently, the costs associated with manufacture and use of additional material increases.

It will also be appreciated that the light source in this type of lamp assembly requires a high voltage pulse (for example, on the order of 10 kV to 50 kV). The pulse is provided through one of the mount leads and thus corrective measures have been taken via insulation of the mount leads or through a protective coating with the reflective surface to limit the potential for arcing as noted above. However, a need exists for a solution that is effective, does not impact lamp performance, and preferably does not adversely impact costs.

BRIEF DESCRIPTION

A lamp assembly includes a light source that requires high voltage for starting. A reflector body includes an electrically conductive reflective surface that receives light from the light source, and a preselected surface portion facing the light source is devoid of the electrically conductive reflective surface. First and second lead assemblies associated with the light source are spaced from the electrically conductive reflective surface portion by the preselected surface portion to preclude arcing therebetween.

The preselected surface portion extends over a truncated portion of the reflector body, which is preferably formed as a surface of revolution.

The preselected surface portion extends on either side from an axis of revolution of the reflector body.

The lead assemblies are preferably asymmetric relative to one another. A portion of a first lead assembly that receives a high voltage pulse for light source starting purposes is spaced a greater dimension from the electrically conductive reflective surface than a portion of a second lead assembly so as to preclude arcing between the first lead assembly and the electrically conductive reflective surface portion.

A method of forming a lamp assembly includes providing a light source and mounting it within a reflector body. The reflector body is formed so that a preselected surface portion is devoid of an electrically conductive reflective material.

The method includes the step of masking the reflector body prior to applying the electrically conductive reflective material.

The method of forming the lamp assembly includes supplying a light source in a reflector body that has an electrically conductive reflective surface, and mounting the light source via first and second lead assemblies that are asymmetrical relative to one another in the reflector body, the first lead assembly receiving a high voltage pulse therethrough and thereby spaced a greater dimension from the electrically conductive reflective surface than the second lead assembly.

A primary advantage of the invention resides in limiting the potential for arcing between the mount leads and the conductive reflective coating.

Another benefit resides in the ability to limit arcing without adversely impacting resulting lamp output.

Another advantage resides in the cost effective manner of providing a solution to the arcing issue.

Still other benefits and advantages of the present disclosure will become apparent from reading and understanding the following detailed description.

DETAILED DESCRIPTION OF THE PREFERRED EMBODIMENTS

Figure 1:
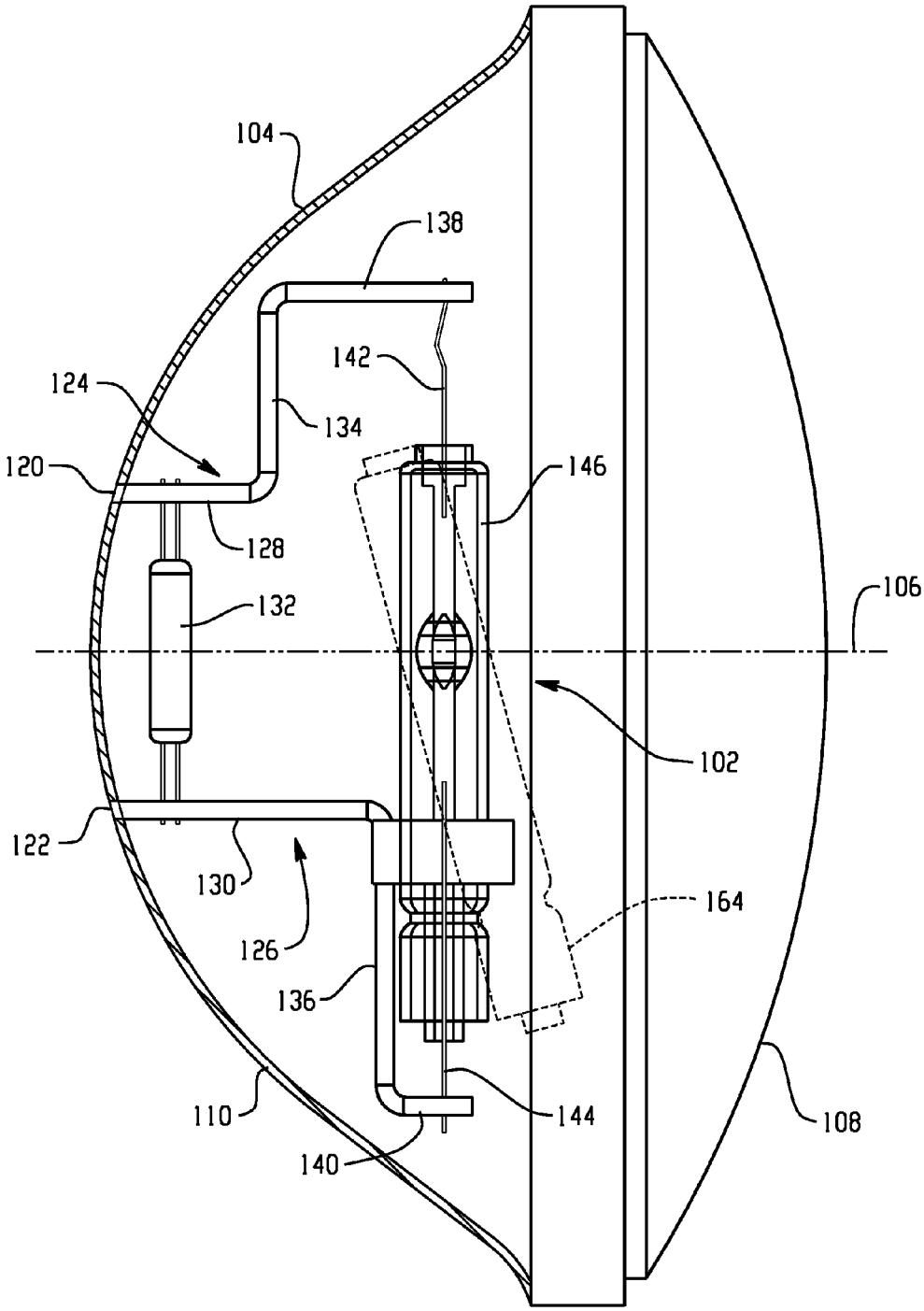
FIG. 1 is an elevational view through a lamp assembly with selected portions shown in cross-section.

Turning first to FIG. 1, a lamp or lamp assembly 100 includes a high-brightness light source 102 which, in this particular embodiment, is a high intensity discharge (HID) light source such as a light source that is sealed relative to the outside environment and contains a noble gas such as nitrogen or argon, or a mixture of the two. The noble gas is typically at a pressure slightly less than standard atmospheric pressure at room temperature. The light source is mounted generally perpendicular to a reflector body 104 which is preferably a surface of revolution, here a paraboloid or parabolic surface about the axis of revolution 106. The light source is preferably mounted near or at a focal point of the paraboloid body so that light received by the reflector body from the light source is directed outwardly through lens 108. More particularly, the body is typically a pressed glass construction, or alternatively may be a plastic construction, in which an interior surface includes a highly polished or reflective surface, which is typically a metal such as aluminum or silver. As will be appreciated, the metal reflective surface is also electrically conductive, although its reflective properties are the primary reason for such use. Thus, the glass substrate 110 is preferably coated along a majority of the interior surface 112 whereby a first, electrically conductive reflective surface portion 112*a* directs the light from the source outwardly through the lens in a generally conventional manner.

A second or preselected surface portion 112*b* is devoid of an electrically conductive reflective material. This is perhaps best illustrated in FIGS. 3 and 4. The second surface portion 112*b* is generally elongated and at least as long as a length of the light source. Moreover, the second surface portion is oriented to substantially conform to a general outline of the light source. Stated another way, the second surface portion has a generally rectangular conformation, i.e., it extends over a truncated portion of the surface of revolution, and the rectangular conformation has rounded corners.

First and second openings 120, 122 are provided in a closed end portion of the reflector body. The openings are dimensioned to receive ferrules that extend into the glass and through which the leads are passed. The ferrules, in turn, receive the first and second mount or lead wire assemblies 124, 126. Although in prior arrangements the first and second lead wire assemblies are symmetrical relative to one another, and generally symmetrical relative to the axis 106, such is not the case in the present disclosure. Instead, each lead wire assembly includes a first or longitudinal portion 128, 130 that extends generally parallel to the axis 106 as it proceeds from the respective opening 120, 122 in the body. A non-conductive, reinforced structural member 132 may be provided between these longitudinal portions 128, 130 to add greater strength to the assembly. In the first leas wire assembly, the longitudinal portion 128 has a slightly smaller axial dimension then that of longitudinal portion 130 of the second lead wire assembly. A second or transverse portion 134, 136 extends generally perpendicular to the first longitudinal portions of the lead wire assemblies. Thus, while the first portions 128, 130 extend generally parallel to the axis of revolution 106, the transverse portions 134, 136 extend generally perpendicular or radially outward. Each transverse portion then merges into a third or another longitudinal portion 138, 140. The light source is mounted between these longitudinal portions 138, 140, particularly outer leads 142, 144 extending from the mount lead wires and sealingly received through opposite ends of the light source envelope 146. The particular details of the high intensity discharge light source are generally known, and do not form a particular part of the present disclosure so that further discussion herein is deemed unnecessary.

Figure 2:
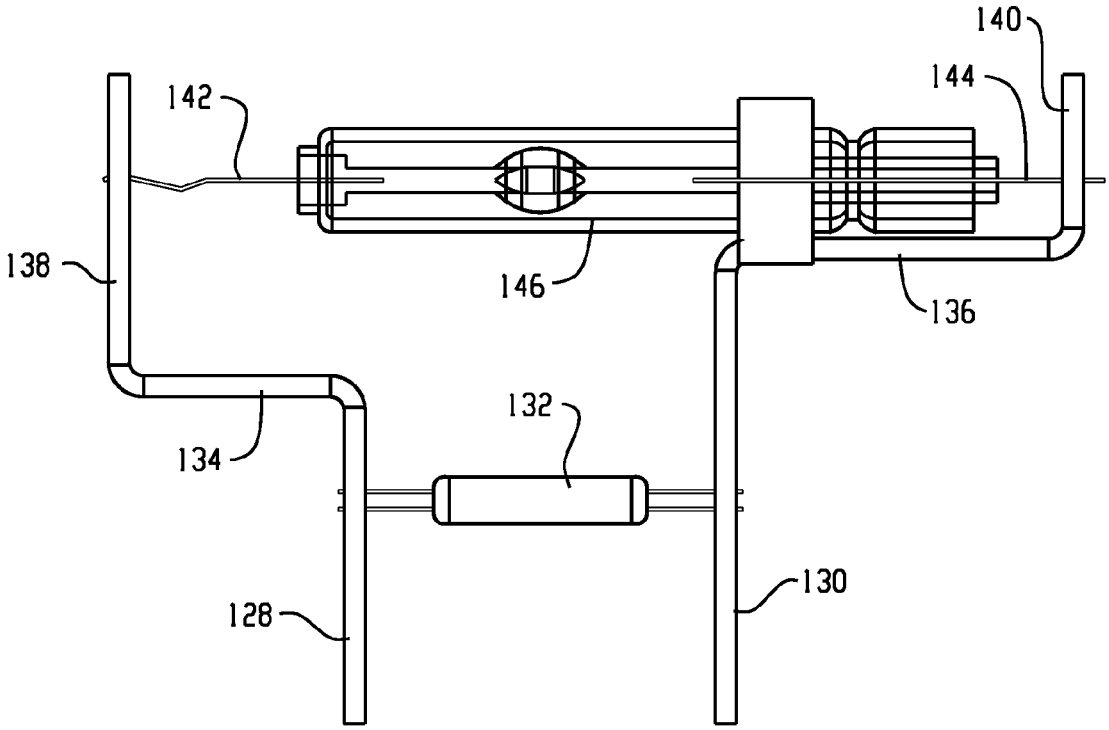
FIG. 2 is an enlarged elevational view of the light source and mount leads of FIG. 1.
Figure 3:
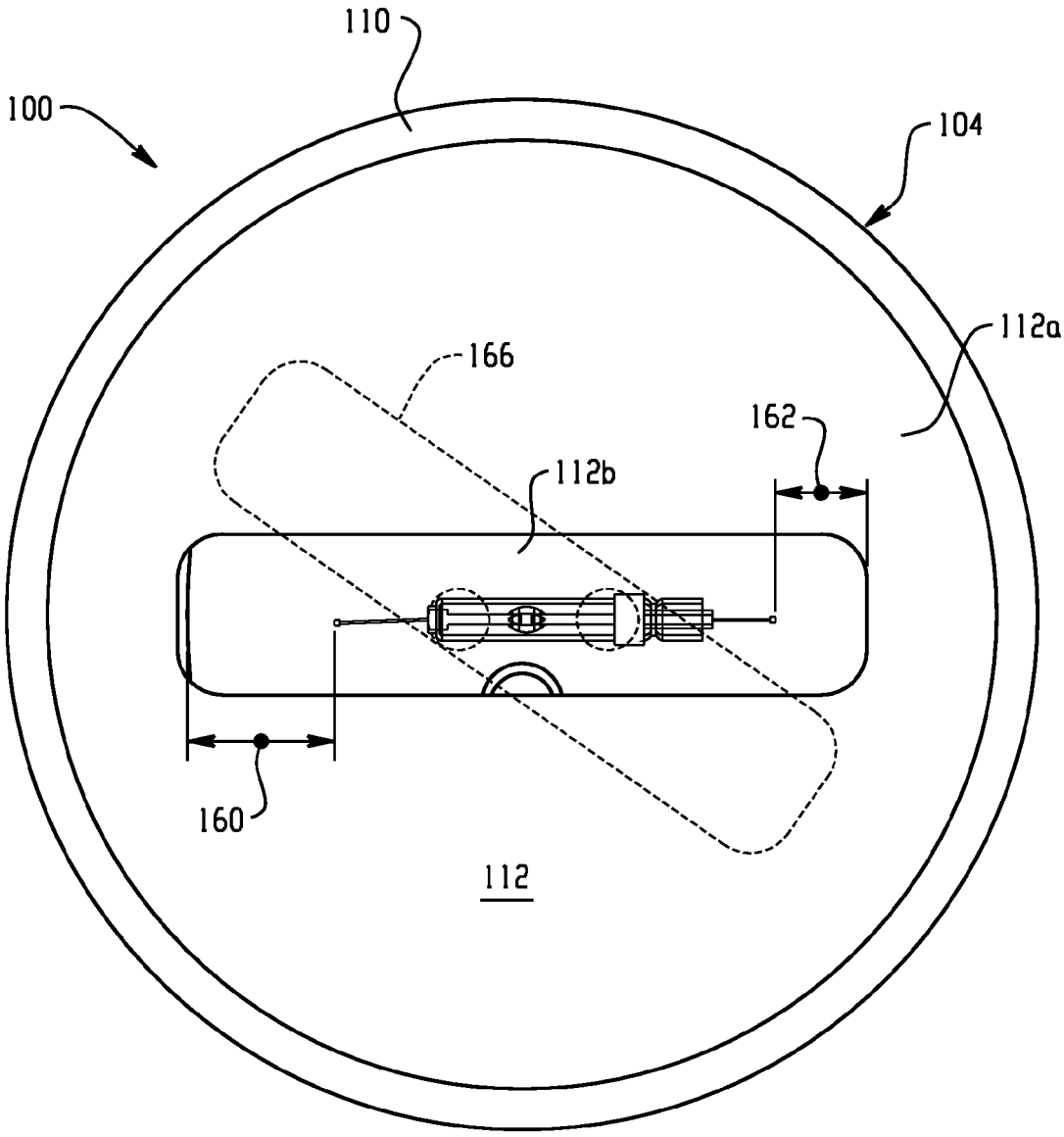
FIG. 3 is a plan view, taken generally along the axis of revolution of the reflector body with the lens removed for ease of illustration.
Figure 4:
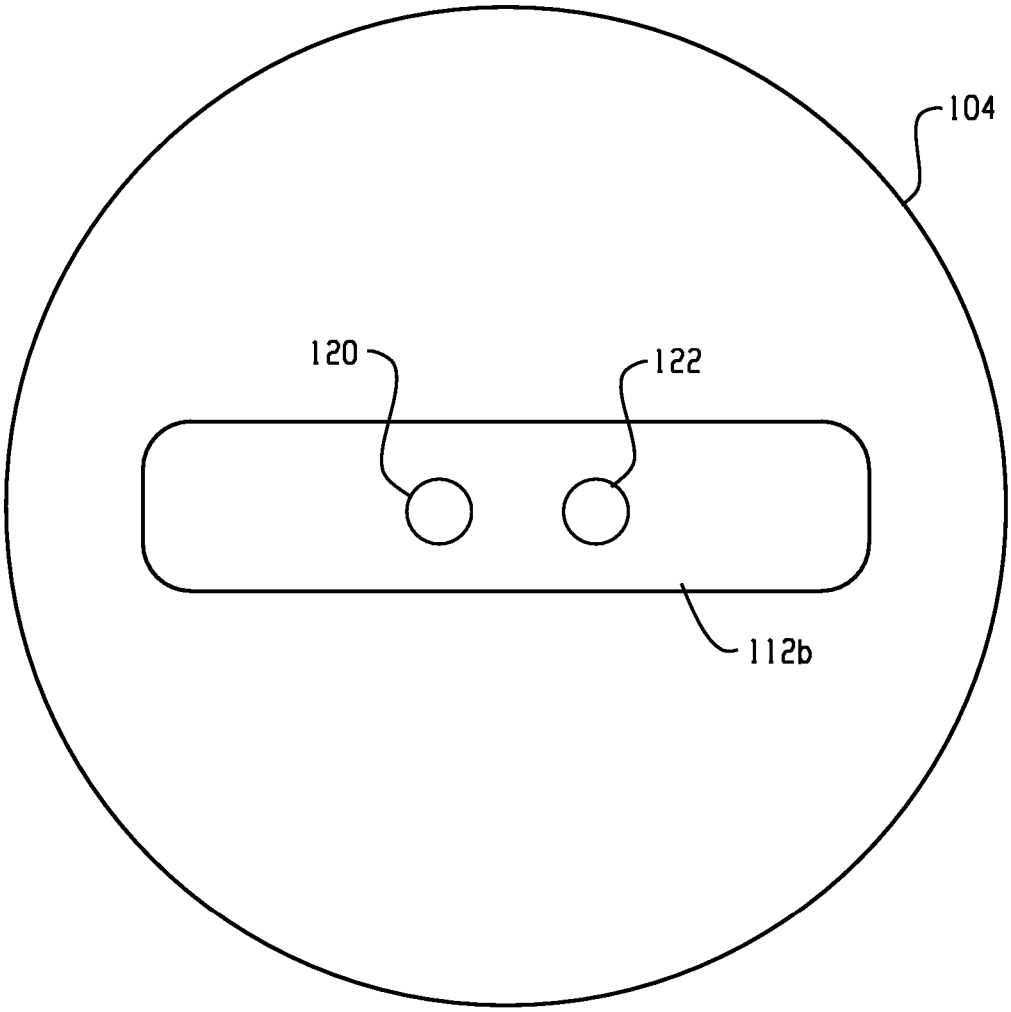
FIG. 4 is a plan view, taken from the back of the lamp.

With continued reference to FIGS. 1 and 2, and additional reference to FIG. 3, the relationship between the asymmetrical lead wire assemblies and the second surface portion 112*b* will be described. As noted previously, it is common to provide a high voltage pulse particularly to start the arc discharge. One of the lead wire assemblies, here the first lead wire assembly 124, is thus more closely positioned adjacent the reflector body 104. Because the first lead wire assembly carries the high voltage pulse, it has the greatest possibility for potentially arcing with the metallic or conductive interior reflective surface 112*a*. Thus, as evident in FIG. 3, the second surface portion 112*b* is devoid of the conductive or reflective surface portion and is spaced a greater dimension from the first lead wire assembly denoted by reference numeral 160. This dimension 160 is compared with dimension 162, which is of reduced length around the second lead wire assembly 126 and the second surface portion 112*b* at that end. Thus, although the light source is generally centered so that the arc discharge gap is located near or at the center of the parabolic body, the second surface portion 112*b* is not necessarily equidistant or symmetrical on either side of the axis of revolution 106. Rather, the extended dimension 160 provides increased insulation resistance or standoff for the high voltage that passes through the first lead wire assembly during starting or ignition of the arc discharge light source. The second lead wire assembly need not be so spaced from the conductive reflective portion 112*a*.

The long, narrow second surface portion 112*b* is prevented from having any of the conductive aluminum or silver deposited thereon. This long section is therefore void of any conducting material which otherwise might adversely contribute to internal arcing between the leas wire assembly and the conductive reflector material. Moreover, using a narrow area with no reflector surface is more cost effective and also has a limited effect on the light output. Although a resulting lamp output will be slightly lower when compared to a lamp without such a cutout, the specifications of the lamp design can be altered to account for this loss in the initial specification. It will also be appreciated that most of the light directed by the reflector body is at the higher or outer perimeter regions of the reflector body, and thus spaced from the second surface portion. Using the non-symmetrical lead wire assemblies also improves the insulation resistance against arcing. As evident in FIG. 4, the absence of any reflective material in the second surface portion 112*b* also means that light can exit through the reflector body 104 (which is a light transmissive glass) in the region defined by the second surface portion 112*b*. This light is simply thrown away or wasted within a surrounding enclosure, fixture, or housing (not shown) and has no impact on lamp design parameters.

In this particular arrangement, the high intensity discharge light source is a short arc discharge, i.e., having an arc gap on the order of 3-5 mm. Although it is also illustrated with a two ferrule or two lead wire assembly, a tripod-type mount can also be used where additional strength or robustness is required. Again, the second surface portion 112*b* is devoid of the conductive reflector surface and can be appropriately dimensioned so that the lead wire assembly that carries the high voltage pulse is maximized in its dimension therefrom, including possible extension about the location of the third lead to prevent arcing. Likewise, the non-symmetrical relationship can be advantageously used to contribute to the electrical insulation impact.

It is further contemplated that the light source may be tilted in order to increase the electrical stand-off from the conductive reflector surface 112*a*. This is represented by the dotted line showing 164 in FIG. 1. Again, the tilt of the light source increases the electrical standoff between the lead wire assembly carrying the high voltage pulse and the conductive reflective surface portion 112*a*. With additional reference to FIG. 3, it will also be understood that the light source can be rotated from a non-perpendicular position as shown in solid line to a rotated, non-perpendicular position represented by dotted line showing 166.

The application of the conductive reflective portion via a vacuum deposition process, or other desired process, is not materially impacted by the modification of the present disclosure. Instead, a mask in the desired shape of the second surface portion 112*b* is added to the interior surface of the glass substrate 110 prior to the vacuum deposition. While masking the reflector during the vacuum deposition process, for example, is simpler than having to add another part or process to achieve improved electrical standoff or isolation, it is also more cost effective than the dichroic coating solution that was previously used and which required a secondary, labor intensive operation. Likewise, the mask arrangement resulting in the second surface portion devoid of any conductive reflective material is less expensive than adding additional components to the lamp to act as an insulator.

According to the method of forming the lamp assembly, the lamp and reflector body are generally formed in a conventional manner fashion, and a preselected portion of the surface of the body is made devoid of an electrically conductive reflector material that otherwise coats the entire internal surface of the surface of revolution. The light source is then mounted in the reflector body in substantially the same manner with proper orientation of the asymmetrical lead wire assemblies as noted above. The second portion that is devoid of the reflective material can be formed by a masking technique or other suitable techniques that result in the first and second portions 112*a*, 112*b*

Of course other conformations of the second portion that is devoid of the conductive reflective material are permitted but one skilled in the art will appreciate that the surface area encompassed by or defined by the second surface portion is dimensioned so that the area will prevent arcing as described previously. Thus, although it is known that small areas on a reflector surface may be devoid of reflective material (e.g., small areas from a portion around the legs to prevent stray light from bouncing back as this area tends not to be smooth), the area must be sufficiently dimensioned, and correlate to the lamp and the operating parameters of the lamp, with the understanding that the high pulse voltage associated with lamp start-up can potentially cause arcing.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A lamp comprising:

a light source that requires high voltage for starting;

a reflector body having an interior surface formed as a surface of revolution including an electrically conductive reflective first surface portion oriented extending along the surface of revolution to receive light from the light source and direct light in a desired direction, the reflector body surface further including a preselected second surface portion also extending along the surface of revolution and oriented to substantially conform to an outline of the light source and directly facing the light source devoid of an electrically conductive reflective material;

first and second lead assemblies operatively associated with the light source for supplying power thereto, the lead assemblies passing through an opening in the reflector body; and the lead assemblies spaced from the electrically conductive reflective first surface portion of the reflector body by the preselected second surface portion to preclude arcing between at least one of the lead assemblies and the electrically conductive reflective first surface portion.

2. The lamp of claim 1 wherein the preselected surface portion is at least as large as a length of the light source.

3. The lamp of claim 1 wherein the electrically conductive reflective surface is one of aluminum and silver.

4. The lamp of claim 1 wherein the reflector body includes a glass substrate formed as the surface of revolution.

5. The lamp of claim 4 wherein the preselected surface portion extends over a truncated portion of the surface of revolution.

6. The lamp of claim 4 wherein the surface of revolution is a paraboloid.

7. The lamp of claim 6 wherein the light source is located at a focal point of the paraboloid.

8. The lamp of claim 1 wherein the reflector body has first and second openings dimensioned to closely receive the first and second lead wire assemblies therethrough.

9. The lamp of claim 1 wherein the light source is an arc discharge light source that is mounted substantially perpendicular to the axis of revolution of the reflector body.

10. The lamp of claim 9 wherein the preselected surface portion intersects the axis of revolution of the reflector body.

11. The lamp of claim 10 wherein the preselected surface portion is a long, narrow section.

12. The lamp of claim 1 wherein the lead assemblies are asymmetric relative to one another.

13. A lamp assembly comprising:

a light source that requires high voltage for starting purposes;

a body formed about an axis including an electrically conductive first surface portion having a reflective material thereon receiving light from the light source and directing the light in a desired direction, a preselected second surface portion devoid of reflective material and oriented to substantially conform to an outline of the light source;

first and second lead assemblies operatively associated with the light source for supplying power thereto, the lead assemblies passing through an opening in the body and being asymmetrical relative to one another; and the first and second lead assemblies each including a portion disposed substantially perpendicular to the body axis, and the portion of the first lead assembly that receives a high voltage pulse for light source starting purposes is spaced a greater dimension from the electrically conductive reflective first surface portion than the portion of the second lead assembly to preclude arcing between the first lead assembly and the electrically conductive reflective first surface portion.

14. A method of forming a lamp assembly comprising:

providing a light source;

providing first and second lead assemblies operatively associated with the light source for supplying power thereto;

forming a reflector body with the lead assemblies passing through an opening in the reflector body and having an electrically conductive reflective material formed as a surface of revolution that includes a first surface portion and a preselected surface second portion oriented to substantially conform to an outline of the light source and devoid of the electrically conductive reflective material positioned entirely within the first surface portion and relative to the light source to inhibit inadvertent arcing between the electrically conductive reflective material and at least one lead supplying power to the light source; and mounting the light source in the reflector body.

15. The method of claim 14 wherein the reflector body forming step includes masking the second portion of the reflector body prior to applying the electrically conductive reflective material.

16. The method of claim 14 further comprising positioning a first mount of the light source at a greater dimension from the electrically conductive reflective material than a second mount.

17. A method of forming a lamp assembly comprising:

supplying a light source in a reflector body that has an electrically conductive reflective first surface portion formed as a surface of revolution, and a second surface portion formed in the same surface of revolution and devoid of an electrically conductive reflective material and oriented to substantially conform to an outline of the light source; and mounting the light source via first and second mounts that are asymmetrical relative to one another in the reflector body whereby each mount passes through an opening in the reflector body and includes a portion that extends generally perpendicular to a surface of the reflector body, and the first mount that receives a high voltage pulse therethrough for lamp ignition includes the mount portion further spaced from the electrically conductive reflective surface, the mounts spaced from the electrically conductive reflective first surface portion of the reflector body by the second surface portion to preclude arcing between the mount and the electrically conductive reflective first surface portion.

* * * * *